US009713561B2

(12) United States Patent
Bennett-Guerrero

(10) Patent No.: US 9,713,561 B2
(45) **Date of Patent: *Jul. 25, 2017**

(54) APPARATUS AND METHODS FOR ORIENTING OR MOVING SURFACES

(71) Applicant: Safer Care LLC, Chapel Hill, NC (US)

(72) Inventor: Elliott Bennett-Guerrero, Chapel Hill, NC (US)

(73) Assignee: SAFER CARE, L.L.C., Chapel Hill, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/689,053

(22) Filed: Apr. 17, 2015

(65) Prior Publication Data

US 2015/0224008 A1 Aug. 13, 2015

Related U.S. Application Data

(63) Continuation of application No. 13/331,982, filed on Dec. 20, 2011, now Pat. No. 9,089,466.

(51) Int. Cl.

| | |
|---|---|
| ***A61G 13/02*** | (2006.01) |
| ***A61G 13/10*** | (2006.01) |
| ***G08B 21/18*** | (2006.01) |

(52) U.S. Cl.

CPC ..... *A61G 13/02* (2013.01); *A61G 13/10* (2013.01); *G08B 21/18* (2013.01)

(58) Field of Classification Search

CPC ..... A61G 13/02; A61G 13/10; G08B 21/18

See application file for complete search history.

(56) References Cited

U.S. PATENT DOCUMENTS

| | | | |
|---|---|---|---|
| 3,728,606 | A | 4/1973 | Finnegan et al. |
| 3,778,769 | A | 12/1973 | Hong et al. |
| 3,839,753 | A | 10/1974 | Benoit et al. |
| 3,913,153 | A | 10/1975 | Adams et al. |
| 3,921,048 | A | 11/1975 | Padgitt |
| 3,961,319 | A | 6/1976 | Asberry |
| 4,044,286 | A | 8/1977 | Adams et al. |

(Continued)

OTHER PUBLICATIONS

Schmitz u. Sö hne "OPX mobilis® Universal Operating Tables with remote control, satisfying high demands in surgery." 2010.

(Continued)

*Primary Examiner* — Sisay Yacob

(74) *Attorney, Agent, or Firm* — Muir Patent Law, PLLC

(57) ABSTRACT

Exemplary embodiments are directed to a controller and/or a procedure table. The procedure table includes a driver that moves the table, and at least one indicator that indicates status of a condition of the table. The controller includes an unlock actuator that enables the driver to move the table, and a lock actuator that prevents the driver from moving the table while enabling the at least one indicator to continue indicating the status. In some exemplary embodiments, the unlock actuator does not enable the driver to move the table until after expiration of a specified delay period that begins upon actuation of the unlock actuator. Other exemplary embodiments also include a delay period indicator that indicates initiation of the delay period upon actuation of the unlock actuator, and that terminates the indication upon expiration of the delay period.

30 Claims, 8 Drawing Sheets

(56) References Cited

U.S. PATENT DOCUMENTS

| | | | | |
|---|---|---|---|---|
| 4,472,845 | A | 9/1984 | Chivetta et al. | |
| 5,053,636 | A | 10/1991 | Zelina | |
| 5,195,198 | A | 3/1993 | Travis | |
| 5,544,376 | A | 8/1996 | Fromson | |
| 5,628,078 | A | 5/1997 | Pennington et al. | |
| 5,698,907 | A * | 12/1997 | Weber | B60J 7/0573 307/10.1 |
| 5,787,528 | A | 8/1998 | Antinori | |
| 5,926,002 | A | 7/1999 | Cavanaugh et al. | |
| 6,363,556 | B1 | 4/2002 | Krauska et al. | |
| 6,983,499 | B2 | 1/2006 | Gladney | |
| 7,174,586 | B2 | 2/2007 | Nagaoka | |
| 7,319,386 | B2 | 1/2008 | Collins, Jr. et al. | |
| 8,474,072 | B2 * | 7/2013 | O'Keefe | A61G 7/018 340/286.07 |
| 2003/0115672 | A1 * | 6/2003 | Newkirk | A61G 7/015 5/600 |
| 2004/0133979 | A1 * | 7/2004 | Newkirk | A61G 13/0036 5/600 |
| 2004/0231052 | A1 | 11/2004 | Gladney | |
| 2006/0107459 | A1 | 5/2006 | Gladney | |
| 2011/0225734 | A1 * | 9/2011 | Huppe | G05B 9/03 5/616 |
| 2012/0073054 | A1 * | 3/2012 | O'Keefe | A61G 7/018 5/618 |
| 2014/0009917 | A1 | 1/2014 | Westermann | |

OTHER PUBLICATIONS

Al Hakim L. "The impact of preventable disruption on the operative time for minimally invasive surgery." Oct. 2011;25(10):3385-92. doi: 10.1007/s00464-011-1735-9. Epub May 18, 2011.

Mediland, "Smart P2000 Surgical Table." Product Data Sheet, Sep. 3, 2009.

Auerhammer J. "Positioning of the patient for surgery" Anaesthesist. Nov. 2008;57(11):1107-24; quiz 1125-6. doi: 10.1007/s00101-008-1424.

Steris, "Surgigraphic 6000 Image Guided Surgical Table." Product Data Sheet. SD768 (Sep. 1, 2006).

* cited by examiner

APPARATUS AND METHODS FOR ORIENTING OR MOVING SURFACES

This U.S. non-provisional patent application is a Continuation of and claims priority to U.S. patent application Ser. No. 13/331,982, filed on Dec. 20, 2011, the entirety of which is incorporated by reference herein.

FIELD

Exemplary embodiments relate to apparatus and methods for orienting or otherwise moving surfaces, such as chair and/or table surfaces.

BACKGROUND

There are numerous contexts in which it is relevant or beneficial to orient or otherwise move chair and/or table surfaces, such as in the healthcare industry, and certain exemplary embodiments are therefore disclosed in the context of healthcare. However, the invention is not solely applicable to healthcare and instead is usable in numerous other contexts, such as aircraft seats, boat seats, workout equipment, construction equipment, etc. The invention is especially relevant, but not limited, to applications where inadvertent movement may cause harm or otherwise be problematic.

SUMMARY

It can be beneficial in the healthcare industry to orient or otherwise move surfaces, such as surfaces of operating room tables or other tables used to support patients during medical procedures (collectively referred to herein as "procedure tables"). Some early procedure tables were manually operated to change orientation, but other related art procedure tables are electronically controlled. In electronically controlled procedure tables, motors are controlled by a controller to move one or more panels of the table to a desired patient position.

Anesthesiology care providers and/or procedure nurses often are directly responsible for changing the procedure table's position by using a table controller (e.g., using the controller for changing table height up/down, tilt left/right, trendelenburg/reverse trendelenburg, back up/down, legs up/down, flex/unflex, and other orientations). During surgery, changes in positioning of the table can be verbally dictated to the procedure nurse by the surgeon. The surgeon typically cannot directly control the table position because he/she must maintain sterility of the surgical gloves. For example, the surgeon may direct the nurse as follows: "please raise the table" or "please tilt the table towards me." The verbal command is then executed by the procedure nurse or other medical professional present in the operating room.

There are critical times during many surgical procedures when any movement of a procedure table can result in injury, including catastrophic injury, to the patient. For example, during brain surgery, when surgical instruments (e.g., scalpel, probes) are near a critical structure, even small movements of the table can result in injury or death. Some related art table controllers allow for the table wheels to be locked, which prevents the table from moving relative to the floor. These table controllers can include a status light to indicate whether the wheels are in a locked or unlocked state. However, this wheel lock feature would not protect a patient from other movements of the table (e.g., a table height up movement), which could be triggered by use of the table controller. Moreover, related art table controller keypads are typically disabled by actuating a table controller "off" switch, which turns off all of the status lights including the critical status light for the wheels locked condition.

Accordingly, it may be beneficial to provide a procedure table and/or controller thereof that can be readily placed in a locked mode, i.e., preventing re-orientation or other table movement, while maintaining the functionality of various table status indicators. It may also be beneficial to provide a procedure table, and/or controller thereof, that includes an alarm and/or delay feature, such that operators, including medical care providers, can be notified prior to the table being changed from the locked mode to an unlocked mode wherein the table is able to be re-oriented or otherwise moved.

A summary of some embodiments is provided below for exemplary purposes only.

Some exemplary embodiments include a controller for use with a procedure table. The table includes a driver that moves the table, and at least one indicator that indicates status of a condition of the table. The controller includes an unlock actuator that enables the driver to move the table, and a lock actuator that prevents the driver from moving the table while enabling the at least one indicator to continue indicating the status.

In some embodiments, the unlock actuator does not enable the driver to move the table until after expiration of a specified delay period that begins upon actuation of the unlock actuator. Other embodiments also include a delay period indicator that indicates initiation of the delay period upon actuation of the unlock actuator, and that terminates the delay indication upon expiration of the delay period.

The unlock actuator can include an unlock button, and the lock actuator can include a lock button that is separate from the unlock button. In other embodiments, the unlock and lock actuators include a single switch defining unlock and lock positions, the unlock position actuating operation of the unlock actuator, while the lock position actuating operation of the lock actuator. In some embodiments, the single switch includes an electro-mechanical switch, while in other embodiments, the single switch includes a transistor. In some embodiments, the unlock and lock actuators are actuated via a touch screen display. The controller can be disposed remote from the procedure table, or alternatively proximal the procedure table.

Some embodiments include an indicator power circuit that provides power to the at least one indicator, and an unlock/lock actuator power circuit that provides power to the unlock and lock actuators, at least a part of the indicator power circuit being separate from the unlock/lock power circuit.

Some exemplary embodiments also include an actuator indicator that indicates actuation of at least one of the unlock actuator and the lock actuator. Exemplary embodiments are intended to cover actuator indicators that: 1) only indicate actuation of the unlock actuator, 2) only indicate actuation of the lock actuator, and/or 3) indicate actuation of both the unlock and lock actuators. In some embodiments that indicate actuation of both the unlock and lock actuators, the actuator indicator provides a first indication upon actuation of the unlock actuator, and a second indication that is different from the first indication upon actuation of the lock actuator.

Providing some sort of indication of actuation of the unlock actuator and/or lock actuator can be beneficial in a variety of respects. For example, in the context of a medical procedure, this indication can facilitate, confirm, and/or ensure that all of the medical care providers involved in the procedure are aware of any upcoming, anticipated, current, or recent change in the procedure table's mode of operation, i.e., unlocked/locked modes. This indication can also provide a mechanism to correct erroneous mode changes before such errors cause an adverse impact. In other words, indication of the mode changing actuation provided by any of the above embodiments can enable medical care providers to take action to reverse erroneous mode changes in a sufficiently timely manner.

Still other exemplary embodiments include an operator actuator, that is separate from the unlock and lock actuators, and that separately provides the operation of at least one of the unlock and lock actuators. In other words, the operator actuator provides a duplicative mechanism for at least one of the unlock and lock actuators. In some embodiments, the operator actuator is in effect a duplicate of only the unlock actuator, while in other embodiments the operator actuator is in effect a duplicate of only the lock actuator. In still other embodiments, the operator actuator is a duplicate of both the unlock and lock actuators.

In some or all of the embodiments that include an operator actuator, the procedure table is structured to support a patient undergoing a medical procedure conducted by a medical care provider, and the operator actuator is structured and disposed to be actuated by this provider. For example, depending on the medical procedure being conducted, the operator actuator can be structured and disposed to be operated by a cardiologist, interventional radiologist, surgeon, or any other relevant proceduralist.

The operator actuator of any of the above embodiments can be beneficial in a variety of respects. For example, in the context of medical procedures, providing the duplicate operation can expedite these procedures by enabling certain medical care provider(s) to directly control mode changes and thereby obviate directing other providers to make the mode changes. This duplicate operation can also enable certain medical care providers to more quickly effect mode changes in emergencies or other situations where such fast action may be beneficial, such as after an erroneous mode change actuation.

Other exemplary embodiments are directed to a procedure table that includes a driver that moves the table, at least one indicator that indicates status of a condition of the table, an unlock actuator that enables the driver to move the table, and a lock actuator that prevents the driver from moving the table while enabling the at least one indicator to continue indicating the status. In some embodiments, the unlock actuator does not enable the driver to move the table until after expiration of a specified delay period that begins upon actuation of the unlock actuator. Other embodiments also include a delay period indicator that indicates initiation of the delay period upon actuation of the unlock actuator, and that terminates the delay indication upon expiration of the delay period.

Other embodiments are directed to a computer program that can be stored on a computer readable storage medium for controlling a procedure table. The procedure table includes a driver that moves the table, and at least one indicator that indicates status of a condition of the table. The computer program includes an unlock program for enabling the driver to move the table, and a lock program for preventing the driver from moving the table while enabling the at least one indicator to continue indicating the status. In some embodiments, the unlock program does not enable the driver to move the table until after expiration of a specified delay period that begins upon actuation of the unlock program. The computer program can also include a delay period indicator program for indicating initiation of the delay period upon actuation of the unlock program, and that terminates the delay indication upon expiration of the delay period.

A more detailed summary of certain features of some of the exemplary embodiments is provided below.

I. Basic Lock/Unlock Feature

In some exemplary embodiments, the operating table can be placed in an unlocked mode, enabling normal operation and/or movement of the table, or alternatively in a locked mode preventing such normal operation and/or movement but continuing to maintain table status indicators. In embodiments that include a controller having a keypad, the locked mode disables the keypad, i.e., prevents it from operating and/or moving the table, but maintains functionality of some or all of the keypad status lights and/or other indicators.

Exemplary embodiments are intended to cover any and all currently known and/or future developed technologies applicable for implementing the above operations. A few such implementing technologies are discussed below for exemplary purposes only, but are not intended as a complete list of possible embodiments.

A. Button Technology

Any currently known or later developed button technology can be used to select and/or switch between the locked and unlocked states or states or modes. For example, when a "Lock Keypad" button is actuated or otherwise selected, any or all of the controller buttons on the keypad are disabled (i.e., actuating such buttons has no effect on table operation and/or movement) with the exception of an "Unlock Keypad" button, but there is no effect on the functionality of status lights and/or other indicators. For example, locking the keypad has no impact on a status light showing whether the wheels are locked or unlocked, to a status light indicating supply of an electrical power source, or to any other status lights. This operation is contrasted with the related art, wherein actuating an "off" button to disable the keypad (and thereby prevent movement of the operating table) also disables or turns off indicators including critically important status lights.

A controller can include controller buttons (hereinafter buttons 1-N), a supply voltage light, an LCD display, and a lock/unlock button. Buttons 1-N are used to actuate or otherwise effect different exemplary functions performed by the controller (i.e., tilting the table, adjusting the height of the table, etc.). The voltage light indicates whether voltage is being supplied to the controller. For example, the voltage light being off, i.e., not illuminated, indicates that no electricity is being supplied to the controller. The LCD display indicates the status of various aspects of the operating table (for example, vertical position of the table, degree of tilt of the table, lock status of the controller, etc.). When the lock/unlock button is in the unlocked position, the controller buttons may be used to effect various table operations, and conversely when the lock/unlock button is in the locked position, the controller buttons 1-N are prevented from effecting various table operations (i.e., actuating the controller buttons will not effect any change in table position). However, status indicators (such as the voltage light and the LCD display) remain operational even when the lock/unlock button is in the locked position.

Exemplary embodiments are intended to cover any and all technologies for switching between the above operations, i.e., locked and unlocked states. For example, in the above embodiment, a single button (lock/unlock button) is used to switch between the locked and unlocked states. In other words, the locked position of the button corresponds to the locked state, while the unlocked position corresponds to the unlocked state. An electro-mechanical switch (i.e., a toggle switch) can be used to switch between the locked and unlocked states. In accordance with another alternative embodiment, multiple buttons, such as two different buttons, can be used, wherein each button corresponds to one of the locked or unlocked states.

1. Electrical/Electronic Technologies

Some exemplary embodiments utilize or otherwise include electrical or electronic technologies to implement the above operations, i.e., locked and unlocked states. A few such embodiments are discussed below for exemplary purposes only, but are not intended as a complete list of possible embodiments to implement the above locked and unlocked operations.

a. Electrical Embodiment 1

As discussed above, exemplary embodiments are intended to cover all technologies for switching between the locked and unlocked states, i.e., single button, multiple buttons, electro-mechanical switch, etc. According to one embodiment, an electro-mechanical switch, such as a toggle switch, connects/disconnects a voltage source to controller buttons that effectuate table operations (including table movement), without affecting voltage supply to a display (LCD, etc.) and/or status lights. This is accomplished by supplying the controller buttons with a separate voltage source. In other words, separately supplying voltage to the controller buttons and voltage to the display and/or indicator lights prevents the table from being moved while maintaining operation of the display/indicators. As indicated above, the toggle switch is disclosed above purely for exemplary purposes, and exemplary embodiments are intended to cover and include any currently known or later developed technologies, such as mechanical, electrical, electro-mechanical, software, and/or chemical technologies for switching between the locked and unlocked states.

A voltage source can be included to provide AC and/or DC voltage to the controller. If AC voltage is provided, then a voltage converter can be used to convert AC voltage to DC voltage for supply to the controller. Alternatively, the voltage source and/or converter may be replaced with a battery (either rechargeable or non-rechargeable) for supplying DC voltage to the controller. A voltage supply light indicates whether voltage is being supplied to the controller. For example, in one embodiment, the voltage supply light illuminates as long as voltage is detected as being supplied to lock/unlock button. Voltage can be supplied to the controller via a voltage supply line, which can branch into three separate lines, wherein a first line supplies voltage to the display (LCD), a second line supplies voltage to voltage supply light, and a third line supplies voltage to the lock/unlock button.

The lock/unlock button (which can be a toggle switch) includes a conducting element. When the lock/unlock button is in the unlocked position, the conducting piece closes the circuit through the lock/unlock button and thereby supplies voltage to controller buttons 1-N. However, when the lock/unlock button is in the locked position, the conducting piece breaks the circuit at the lock/unlock button to prevent voltage from being supplied to the controller buttons 1-N, but voltage is still supplied to indicators, such as the voltage supply light and the LCD display. In other words, in the locked position, none of buttons 1-N are operational, but the indicators and/or status lights remain operational.

b. Electrical Embodiment 2

In another embodiment, the electro-mechanical switch (toggle switch) disclosed above is replaced with a transistor. In other words, a transistor is used as a lock/unlock button to connect/disconnect the voltage source to the controller buttons 1-N without affecting the display (LCD) and status lights. Similarly to the above embodiment, this embodiment provides this feature by separately supplying voltage to the controller buttons 1-N and the display/voltage supply light. In this embodiment, the circuitry of each of the controller buttons 1-N includes a single and separate transistor.

When an actuator (such as an operator's finger) contacts and thereby actuates a button, the resistive characteristics of the finger transfers the current. In other words, the tip of the finger makes a circuit. Resistors transfer the voltage to the base of the transistor. The voltage turns on the transistor, causing current to flow through the drain of the transistor. The current is input to controller button N, flows through resistors, and turns on the controller button N transistor, resulting in activation of a load. The load is the desired function to be performed by button N, such as adjusting the horizontal position of the table.

The circuit is broken when the finger is removed. Breaking this circuit turns off the transistor, which turns off controller button N transistor, and thereby places controller button N in the locked position. As discussed above, the other controller buttons can operate similarly to controller button N 2. Processor Implemented Technologies Other exemplary embodiments utilize or otherwise include processor based technologies to implement the above operations. A few such embodiments are discussed below for exemplary purposes only, but are not intended as a complete list of possible embodiments.

a. Processor Based Embodiment 1

In one such exemplary embodiment, a flat-panel membrane keyboard utilizes processor based technology to effect the lock/unlock states and to implement other controller button operations discussed above. For example, the function of each button can be pre-defined within the processor. The processor detects actuation of either of the lock/unlock states and sends commands accordingly. For example, in the locked state, the processor sends commands to prevent execution of table operations (such as table movement), i.e., operations actuated by controller buttons 1-N discussed in the above embodiments. Alternatively, in the unlocked state, the processor enables commands to be sent to allow execution of table operations (such as table movement), i.e., operations actuated by controller buttons 1-N discussed in the above embodiments.

In another embodiment, the above disclosed toggle switch and transistors are replaced with processor based technology to implement the lock/unlock operations. For example, the buttons can be implemented using flat-panel membrane keyboard technology, such as the technology commonly used to control appliances, i.e., microwave ovens, photocopiers, etc. Two separate buttons can also be provided to switch between the locked and unlocked states, wherein one button initiates the locked state and the other button initiates the unlocked state.

An exemplary embodiment employs a two-button flat-panel membrane keyboard. According to this embodiment, each button of the flat-panel membrane keyboard includes three layers. One layer includes labels of other indicators that specify the function of each button to an operator (i.e. "Lock" on the lock button). The first layer and a third layer are conductive, while a second middle layer is an insulating spacer layer, which insulates or otherwise separates the first and third layers so that they are not normally electrically conductive, i.e., the first and third layers do not normally make an electrical circuit. The first and third layers each include electrical stripes that extend perpendicular relative to each other, i.e., the electrical stripes of the first layer are perpendicular to the electrical stripes of the third layer. Thus, if an operator's finger contacts one of the buttons, then the electrical stripes of the first and third layers of that button form a grid. A voltage is transmitted to a processor that communicates with the keypad once the two conducting layers are in contact. The processor is thereby informed of the physical position on the grid where a voltage is detected. The processor then implements a function, based on its pre-programming, corresponding to the physical position on the grid. In other words, the processor sends commands consistent with the button that is selected, such as operating consistent with the locked state if the lock button is actuated.

The processor can be pre-programmed to perform other related or unrelated operations. For example, if the locked button is actuated so as to call-up the locked button instructions, then the processor can be programmed to stop executing or otherwise interrupt functions corresponding to other buttons (except the unlock button) even if actuated. In one such example, actuating the lock button would interrupt any table movement that may be in progress. Similarly, the processor can be programmed to resume operation (i.e., reactivate previous instructions) of other buttons that are actuated once the unlocked button is actuated. For example, if a button is actuated to instruct table movement, but this movement has been interrupted by the table being placed in the locked state, then the processor can be programmed to move the table upon entry into the unlocked state.

The voltage(s) supplied to the voltage light and the LCD, as discussed with respect to one of the above embodiments, are unaffected at all times, regardless of whether the keyboard is locked or unlocked. Therefore, even in the locked position, while none of the buttons 1 through N are operational, the indicators and all the status lights are unaffected and still active.

B. Non-Button Technologies

As an alternative to the above exemplary embodiments that utilize buttons, other currently known or later developed technologies can be used to select and/or switch between the locked and unlocked modes. For example, exemplary embodiments are intended to cover touch screens or other currently known or later developed types of keypads for performing the operations discussed above.

The operation of a buttonless embodiment is very similar to that of the processor based embodiment disclosed above. The two embodiments are very similar in that the physical location where a button is pressed (or where a touch screen panel is touched) is detected, and a processor implements a pre-programmed function corresponding to that physical location.

1. Non-Button Embodiment 1

In one exemplary embodiment, a resistive touch screen panel is used. The panel is composed of several layers, the most important of which are two thin, electrically conductive layers separated by a narrow gap. When an object, such as a finger, presses down at a location on the panel's outer surface, the two metallic layers become connected at that location. The panel then behaves as a pair of voltage dividers with connected outputs. This causes a change in the electrical current, which is registered as a touch event, and the location of the change in the electrical current is sent to the controller for processing. The processor, which has a set of pre-programmed functions for each physical location, then executes the corresponding function. One exemplary function can be terminating execution of the functions corresponding to all of the touch buttons on the panel used for adjusting the positing of the table once a change in current is sensed at the location corresponding to the lock mode. Another exemplary function can be activating the execution of the functions corresponding to all the touch buttons on the panel used for adjusting the positioning of the table, once a change in current is sensed at the location corresponding to the unlock mode.

According to one resistive based touch screen embodiment, the processor can be pre-programmed, such that when the panel is touched and a change in the electrical current at the physical location corresponding to the lock button is detected, the associated instruction is called to stop executing functions corresponding to the location of all of the other buttons (except the unlock button) on the controller regardless of whether or not they are touched. Similarly, the processor can be pre-programmed, such that when the panel is touched and a change in the electrical current at the physical location corresponding to the unlock button is detected, the associated instruction is called to reactivate the instructions corresponding to the location of all of the other buttons on the controller. Appropriate functions will then be performed when these other buttons are pressed.

The above embodiments can be provided with an additional safety feature to prevent table operations, such as table movement, when in the locked state. For example, the processor based embodiments can separately supply voltage to the indicators/displays and the controller buttons to provide such protection.

2. Non-Button Embodiment 2

An alternative processor based embodiment replaces the resistive based touch screen with a capacitive touch screen panel. An exemplary capacitive touch screen panel includes an insulator (such as glass) coated with a conductor. This technology is based on the fact that the human body is also an electrical conductor, and thus touching the surface of the screen (at a specific contact location) results in a distortion of the screen's electrostatic field and a measurable change in capacitance.

Many different technologies may be used to determine the contact location of the screen, and to then communicate the contact location to the processor. The processor can be programmed to have a set of pre-programmed functions corresponding to each contact location, such that the processor executes commands for a certain function upon determining that the corresponding screen location has been contacted. For example, the processor can execute commands consistent with ceasing all table movement upon determining that a location of the screen corresponding to the locked button has been touched.

As discussed above, this embodiment can be provided with an additional safety feature to prevent table operations, such as table movement, when in the locked state. For example, the capacitive touch screen panel embodiment can separately supply voltage to the indicators/displays and the controller buttons to provide such protection.

C. Wireless Technologies

The exemplary embodiments are discussed above in the context of hard wired apparatus, which may be advantageous based on the requirements of an operating room. However, any or all of the technologies discussed above can alternatively be implemented using wireless technologies. For example, appropriate transmitter(s) and receiver(s) can be incorporated into any of the embodiments discussed above. In one such embodiment, the controller is provided with a transmitter, and the operating table is provided with a receiver. Alternatively, both the controller and the operating table may be equipped with a transceiver, enabling both the controller and the operating table to communicate back and forth with one another.

In another exemplary embodiment, the controller includes a transmitter and/or transceiver, and the operating table includes a receiver and/or transceiver. The transmitter/transceiver and receiver/transceiver are each intended to cover any and all currently known and/or future developed applicable technologies.

II. Delay Feature

A. Basic Delay Operation

In addition, or as an alternative to the operations discussed above in Section I, the controller/table can be provided with a delay feature, wherein the system remains in the locked mode for a period following actuation of the unlocked button or other device. In other words, a delay separates actuation of the unlocked button or other actuation device and initiation of the actual unlocked operation of the table.

Exemplary embodiments are intended to cover any and all currently known and/or future developed technologies applicable for implementing the above delay. A few such implementing technologies are discussed below for exemplary purposes only, but are not intended as a complete list of possible embodiments.

1. Electrical/Electronic Technologies

Some exemplary embodiments utilize or otherwise include electrical or electronic technologies to implement the above delay, such as a time-delay circuit. In one exemplary embodiment, a capacitor charges-up when an electrical connection is made between contacts via an operator's finger. However, voltage does not turn on a transistor until the capacitor charges completely. Similarly, when the electrical connection is broken between the contacts (i.e., the operator's finger is removed), the voltage does not disappear (to thereby turn off the transistor) until the capacitor discharges. The capacitor thereby introduces a delay from the time when the connection is made between the contacts and the time when the transistor is turned on. Similarly, the capacitor introduces a delay from the time when the connection is broken between the contacts and the time when the transistor is turned off. The value of the capacitor can be calculated to provide the desired time delay.

2. Processor Implemented Technologies

Other exemplary embodiments utilize or otherwise include processor based technologies to implement the above delay. Exemplary embodiments that include processor based technologies to implement the intended delay function are similar to previously disclosed processor based embodiments, except for the inclusion of a delay. For example, the previously disclosed processors can be modified to include instructions for executing a specified delay before implementing the unlocked state.

3. Non-Button Technologies

Other exemplary embodiments utilize or otherwise include touch screen based technologies to implement the above delay. Exemplary embodiments that include touch screen based technologies to implement the intended delay function are similar to previously disclosed touch screen based embodiments, except for the inclusion of a delay.

B. Delay Indication

Other exemplary embodiments additionally provide an alarm or other indication that the delay has begun. In other words, upon enabling the keypad, an alarm or other indicator alerts the operator, such as a surgeon, to the fact that the unlocked mode has been actuated and thus the table (and patient) may be moved. This allows the operator, such as a surgeon, to perform at least one of the following: 1) tell the individual with the controller to NOT change the table position, 2) quickly remove his/her hands or any surgical instruments that may be at risk of damaging the patient if the table moves, or 3) do nothing if the critical part of the procedure is over and the surgeon would like a change in position of the table, or has no objection to a change in the position of the table.

Exemplary embodiments are intended to cover any and all currently known and later developed technologies for providing the above indication. For example, an alarm, e.g., a beeping sound, can be emitted at intervals, such as every second for three seconds, for example, to alert the surgeon and/or other clinicians that someone has unlocked the keypad presumably with the intention of changing the table's position. After the three second delay, all of the keys/buttons that control the table will become functional. Other embodiments include longer or shorter periods of delay, although it may be beneficial for the delay to be longer than two seconds to provide sufficient time for recognition that the keypad is being enabled and for appropriate or defensive actions to be taken. Other embodiments can include a continuous beep or other alarm. Exemplary embodiments are even intended to cover other types of indicators that do not use sounds, such as visual indicators including but not limited to flashing lights.

In fact, exemplary embodiments are intended to cover any and all currently known and/or future developed technologies applicable for indicating the above delay. A few such implementing technologies are discussed below for exemplary purposes only, but are not intended as a complete list of possible embodiments.

1. Electrical/Electronic Technologies

Some exemplary embodiments utilize or otherwise include electrical or electronic technologies to indicate the above delay.

2. Processor Implemented Technologies

Other exemplary embodiments utilize or otherwise include processor based technologies to implement the above delay.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

Figure 1:
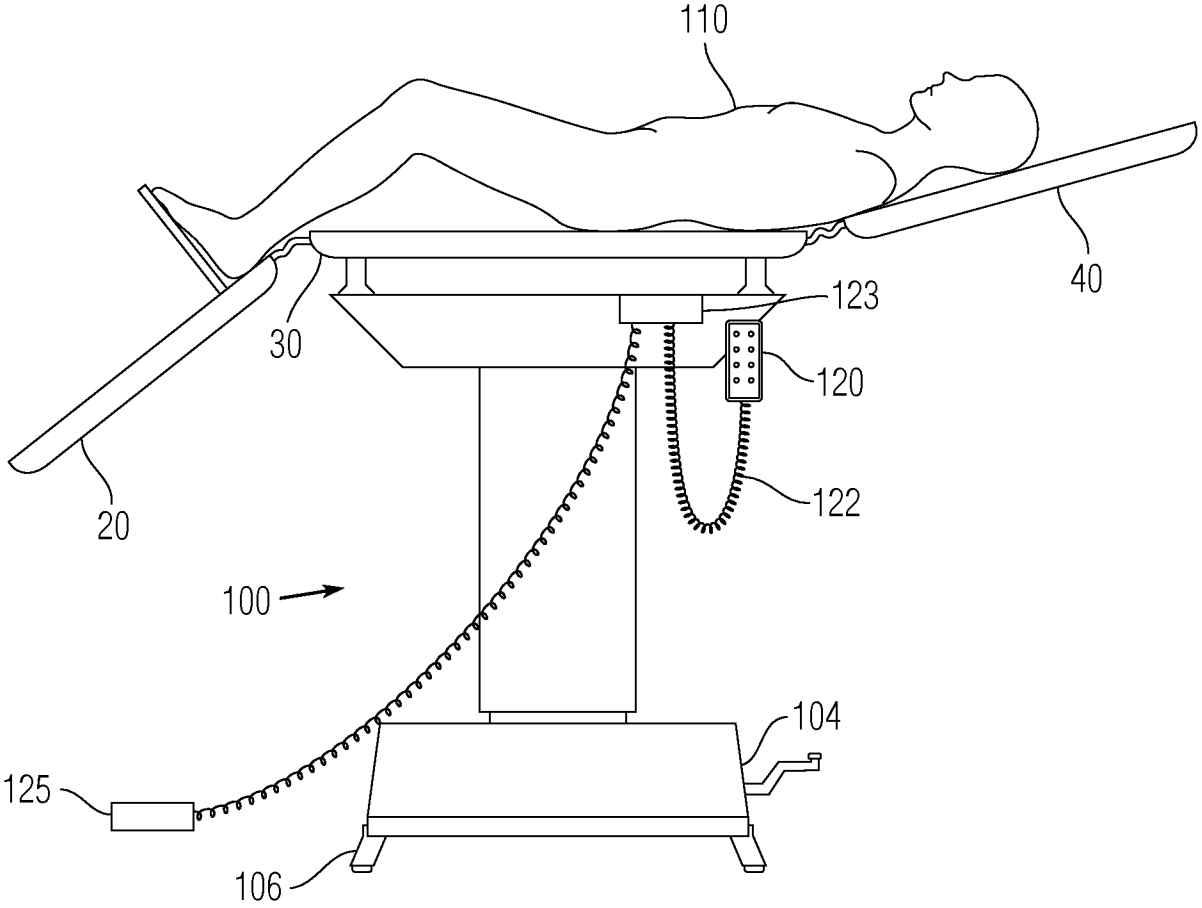
FIG. 1 shows an exemplary embodiment of a procedure table including a controller.

It is to be understood that both the foregoing general description and the following detailed description are exemplary and explanatory only, and are merely intended to provide an exemplary explanation of various embodiments of the present teachings.

DETAILED DESCRIPTION

Exemplary embodiments relate to orienting or otherwise moving chair or table surfaces, such as for use in the healthcare industry, and thus some of the exemplary embodiments are disclosed below in that context. However, as disclosed above, the invention is not solely applicable to healthcare and instead is usable in numerous other contexts.

Some of the exemplary embodiments applicable to the healthcare industry relate to orienting or otherwise moving surfaces of operating room tables or other tables used to support patients during medical procedures (collectively referred to herein as "procedure tables"). While many procedure tables are used in operating rooms, procedure tables can also be used in other areas of the hospital including cardiac catheterization laboratories, interventional radiology, neuroradiology, gastroenterology procedure rooms, emergency trauma bays, and even in zoos or veterinary hospitals for use with procedures on animals. Still other exemplary embodiments in the healthcare industry relate to hospital beds used for patients at home, in floor/ward/non-acute settings of hospitals, nursing homes or skilled nursing facilities, etc. Still further exemplary embodiments are used in other healthcare fields, including dentistry.

In one exemplary embodiment, orientation and/or other movement of the table is prevented, i.e., the table is in the "locked" position, while functionality of one or more status lights or indicators is maintained. For example, if a wheels locked condition has been actuated when orientation/movement of the table has been disabled, then a status light for the wheels locked condition will remain on. The table can also include a delay and/or alarm feature, such that operators, including medical care providers, can be notified prior to the table actually becoming unlocked, i.e., able to be re-oriented or otherwise moved. In one such embodiment, the table remains in a locked state, i.e., preventing re-orientation or other table movement, for several seconds after being actuated into the unlocked state, i.e., a state allowing table re-orientation or other movement. In another embodiment, an alarm can sound for a predetermined period of time (e.g., several seconds) after the table has been changed from the locked state into the unlocked state, such as during the delay period disclosed above. In other words, the alarm and/or delay feature provides an alert to medical professionals to make them aware that the table, and in turn the patient, may be moving in the immediate future.

Some embodiments include a controller that controls table orientation, movement, or other operations. The controller can be provided at or on the table, or alternatively can be remote from the table and communicate with (such as by sending commands and/or receiving data) the table via a cord or by way of wireless communication.

FIG. 1 shows a procedure table 100 having an upper surface on which a patient 110 can be supported while a specific medical operation is being performed. In the embodiment shown in FIG. 1, the patient 110 is human, either dead or alive. However, other embodiments include tables for animals (either dead or alive), or other organisms. Exemplary embodiments are especially applicable in the context of sensitive operations, where even a slightest inadvertent movement to the procedure table 100 can prove detrimental or even fatal. Still other embodiments do not relate to patients or other organisms.

The upper surface of the procedure table 100 can include one or more movable sections. In the embodiment shown in FIG. 1, the procedure table can include three movable sections, 20, 30, 40. Each of the movable sections 20, 30, 40 can be adjusted independently of each other via a driver 123. The driver 123 is merely shown for exemplary purposes, and embodiments are intended to cover any currently known and/or later developed method or apparatus for driving or otherwise moving the movable sections 20, 30, 40. For example, the driver 123 can be an electric motor, pneumatic motor, utilize hydraulics, etc. In fact, exemplary embodiments are intended to cover any number of separately movable sections, including a single movable section.

FIG. 1 also shows a controller 120 remotely connected by way of a cord 122 to the driver 123 or any other portion of the procedure table 100. Alternatively, the table controller 120 can be integrated directly into the procedure table 100, such as being attached to the side of the table 100. The controller 120 communicates with, or otherwise controls, the driver 123 to move the movable sections 20, 30, 40 of the procedure table 100. As another alternative, the controller can communicate with, or otherwise control, the driver to move the movable sections 20, 30, 40 of the table 100 via wireless communication.

Exemplary embodiments are intended to cover any procedure table structure. The table 100 shown in FIG. 1 includes a base 104 that can be supported on wheels or rollers 106 to allow the procedure table 100 to be readily moved relative to the floor.

Figure 2:
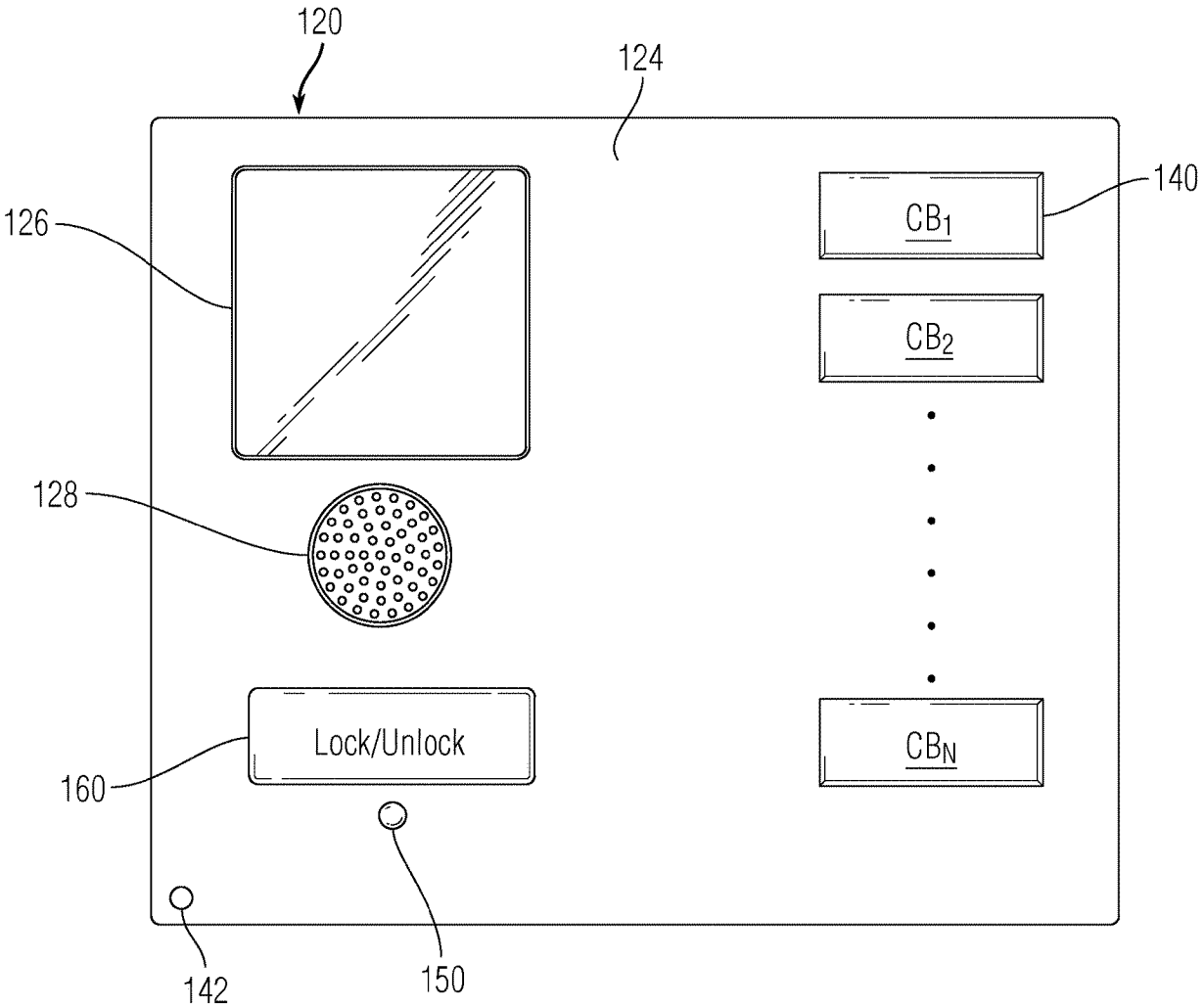
FIG. 2 is a schematic of an exemplary front face of a controller.

FIG. 2 shows an exemplary front face of the controller 120, including a keypad 124. The keypad 124 can include one or more buttons, switches, and/or keys that can be contacted by a user to actuate and de-activate various controller functions. Some of the buttons, switches, and/or keys labeled as 140 can be used to make tilting and height adjustments to the upper surface of the procedure table 100. One or more buttons, switches, and/or keys labeled as 160 can be used to lock or unlock the keypad 124 of the controller 120. The controller 120 can also include additional components to control the mode of operation of the controller 120. These additional components can include, for example, a visual display 126 and an audio capability 128. The keypad 124 can also include one or more status lights 150 to indicate the operational status of the one or more buttons, switches, and keys 140, 160. As shown in FIG. 2 with respect to button 160, a status light 150 can be arranged next to, under, or generally in the vicinity of, the corresponding button, switch, and key to which it is referencing.

One exemplary controller 120 includes locked and unlocked modes. In the unlocked mode, the normal operation and/or orientation/movement of the procedure table 100 is enabled. In the locked mode, normal operation and/or orientation/movement are prevented, but operation(s) of the status lights and indicators are maintained. In embodiments that include a controller 120 having a keypad 124, the locked mode disables the keypad 124, thereby preventing the keypad 124 from being used to operate and/or move the table 100, but maintains functionality of some or all of the keypad status lights 150 and/or other indicators 126, 128. For example, in the locked mode, all of the buttons 140 on the keypad 124 are disabled, with the exception of the button 160 corresponding to placing the controller 120 in an unlocked mode.

According to various embodiments, the controller 120 can be locked and unlocked by the actuation of one or more buttons/actuation devices corresponding to the locking and unlocking functions. For example, as shown in FIG. 2, the keypad 124 can include a single button 160, which can be labeled "Lock/Unlock" (or other relevant indication), that allows the controller 120 to be toggled between the locked and unlocked modes. Alternatively, the keypad 124 can include a pair of buttons or other actuation devices, such as a device first labeled "Lock Keypad" and a second device labeled "Unlock Keypad" to toggle between the locked and unlocked states. Regardless of the specifics of the arrangement of the keypad locking buttons 160, they are differentiated from the functionality of the status lights of the controller 120. For example, locking the keypad 124 has no impact on the status light showing whether the wheels are locked or unlocked, or the status light related to the electrical power source, or to any other status lights.

Other embodiments can include other operations in addition to any or all of the operations disclosed above. In one such embodiment, when the "Unlock Keypad" button 160 is selected, the other buttons of the keypad 124 are not immediately functional for a predetermined delay period. Instead, an alarm can be emitted to alert the surgeon and/or other clinicians that someone has unlocked the keypad 124, presumably with the intention of changing the position of the procedure table 100 in some way. For example, the alarm can be a beeping sound emitted every second for three seconds corresponding to the predetermined delay period. After the predetermined delay period, all of the buttons 140 of the controller 120 can become functional again. According to various embodiments, the alarm can be any visual, audible, or other type of indication to place the surgeon and/or other clinicians on notice that the controller 120 is (or about to become) operational.

The delay period can be any period of time, although it may be beneficial for the delay to exceed a certain period, such as two seconds, to allow sufficient time for the surgeon to recognize that the keypad 124 is being enabled and for appropriate or defensive actions to be taken. Moreover, it may be beneficial for the delay to not exceed a certain period, such as five seconds, because too long of a delay may be deleterious if the procedure table 100 needs to moved, as in an emergency. According to various embodiments, the alarm can be continuous, such as a continuous sound as opposed in an intermittent beep.

The alarm and delay period allows a medical care provider, such as a surgeon, to perform one of several actions as appropriate: 1) tell the medical professional operating the table controller to not change the table position, 2) quickly remove his/her hands or any surgical instruments that may be at risk of damaging the patient if the table moves, or 3) do nothing if the critical part of the procedure is over and the surgeon would like a change in position of the table 100 or has no objection to a change in the position of the table 100.

The controller 120 can be operated without enabling the "Lock Keypad" mode. For example, during portions of a procedure where table 100 movement is less critical or even desirable, such as when positioning the patient prior to starting the operation, it may be beneficial to use the controller 120 with the "Unlock Keypad" mode on.

A status light 150 can be provided for each of the "Lock Keypad" and "Unlock Keypad" buttons 160 to indicate to a user when either the locked mode or the unlocked mode is on. For example, a status light 150 can be arranged to the side or under (i.e., to illuminate from below) these buttons, which will become illuminated when either mode is on. Moreover, one or more status lights can be arranged on the visual display 126 to show the current status of corresponding indicators, such as the current status of a wheels locked condition. The visual display 126 can be an LCD display.

Various button, key, or switch technology can be used to select and/or switch between the locked and unlocked modes, or to make tilting and height adjustments to the upper surface of the procedure table 100.

FIG. 2 shows an exemplary controller 120 including controller buttons 140 (referred to as $CB_1$, $CB_2$, through $CB_N$), status lights 150, supply voltage light 142, visual display 126, and keypad locking button 160. Controller buttons 140 ($CB_1$ through $CB_N$) can be used to actuate or otherwise effect different exemplary functions performed by the controller 120 (i.e., tilting the table, adjusting the height of the table, etc.). The supply voltage light 142 can indicate whether voltage is being supplied to the controller 120. For example, the supply voltage light 142 not being illuminated indicates that no electricity is being supplied to the controller 120. The visual display 126 can indicate the status of various aspects of the procedure table (for example, vertical position of the table, degree of tilt of the table, lock status of the controller, lock status of the wheels, etc.). When the lock/unlock button 160 is in the unlocked position, the controller buttons 140 can be used to effect various table operations, and conversely when lock/unlock button 160 is in the locked position, the controller buttons 140 are prevented from effecting various table operations (i.e., actuating the controller buttons 140 will not effect any change in table position). However, status indicators (such as supply voltage light 142, visual display 126, status lights 150, and the like) remain operational even when lock/unlock button 160 is in the locked position.

As disclosed in FIG. 2, a single lock/unlock button 160 can be used to switch between the locked and unlocked modes. Alternatively, two or more locking buttons 160 can be implemented on the controller 120 so that each button separately corresponds to one of the locked or unlocked modes. An electro-mechanical switch can be implemented to switch between the locked and unlocked modes. Such an electro-mechanical switch can be a toggle switch.

Figure 3:
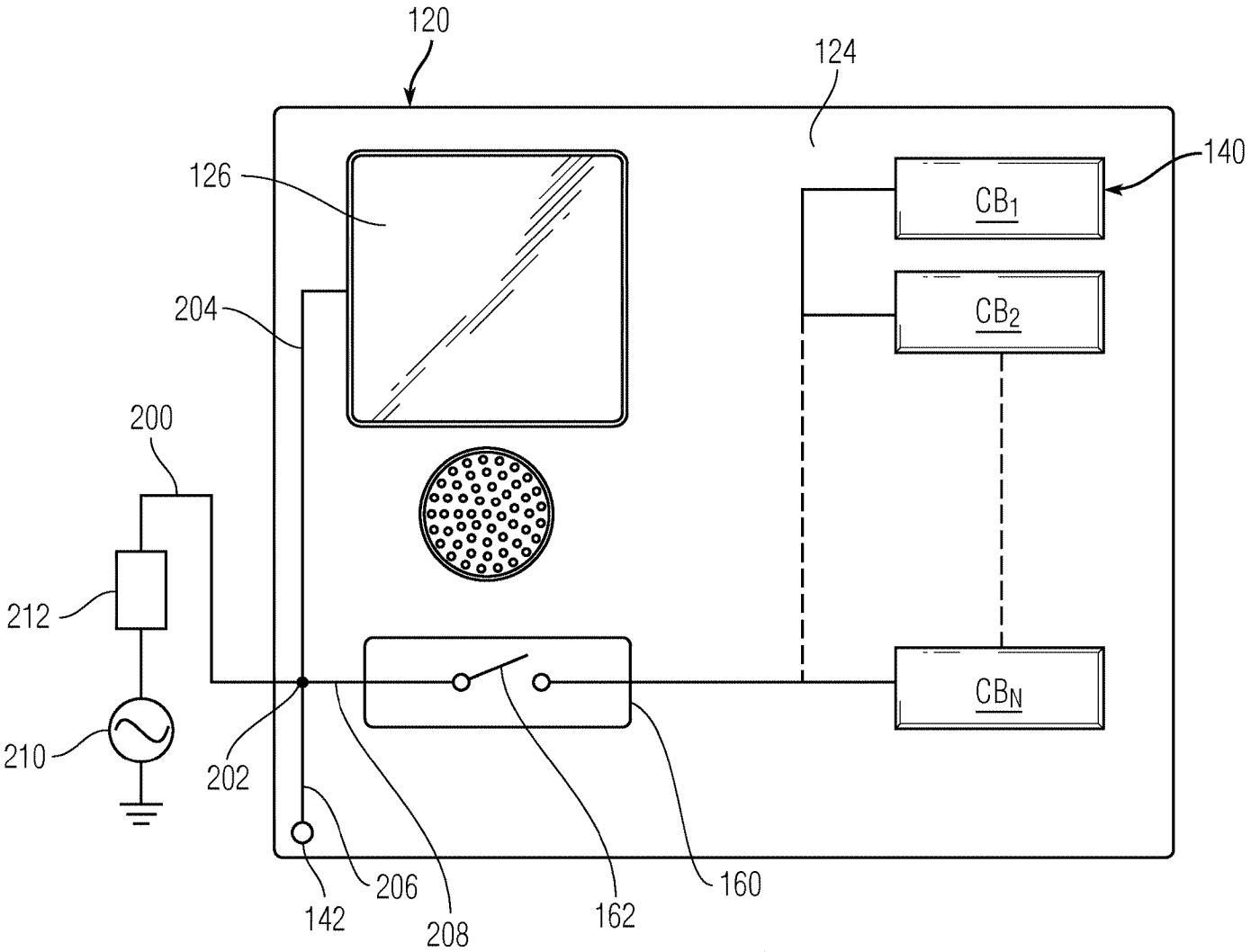
FIG. 3 is a schematic of an exemplary front face of a controller including an electro-mechanical toggle switch for controlling the lock/unlock modes.

FIG. 3 shows an electro-mechanical toggle switch 160 connecting and disconnecting a voltage source 210 to the controller buttons 140 that effectuate table motion operations (including table movement), without affecting voltage supply to the status indicators (such as supply voltage light 142, visual display 126, status lights 150, and the like). This can be accomplished by separately controlling the supply of power to the controller buttons 140. By separately supplying voltage to the controller buttons 140 and to the status indicators prevents the table from being moved while maintaining operation of the status indicators. The toggle switch 160 of FIG. 3 is disclosed for exemplary purposes and any currently known or later developed switching technologies could be implemented for switching between the locked and unlocked modes. Such switching technologies can include mechanical, electrical, electro-mechanical, software, and/or chemical technologies, for example.

As shown in FIG. 3, a voltage source 210 can be arranged to provide AC and/or DC voltage to the controller 120. If an AC voltage source is provided, then a voltage converter 212 can be used to convert AC voltage to DC voltage for supply to the controller 120. Alternatively, the voltage source 210 and/or converter 212 can be replaced with a battery (either rechargeable or non-rechargeable) for supplying DC voltage to the controller 120. The supply voltage light 142 can indicate whether voltage is being supplied to the controller 120. For example, in one embodiment, the supply voltage light 142 illuminates as long as voltage is detected as being supplied to the lock/unlock button 160, such as at position 202. Voltage can be supplied to the controller 120 via a voltage supply line 200, which can branch into separate lines at position 202, wherein line 204 supplies voltage to the visual display 126, line 206 supplies voltage to voltage supply light 142, and line 208 supplies voltage to the lock/unlock button 160.

The toggle switch, defining the lock/unlock button 160 of FIG. 3, includes a switchable conducting element 162. When the lock/unlock button 160 is in the unlocked position, the conducting element 162 closes the circuit through the lock/unlock button 160 and thereby supplies voltage to controller buttons 140 ($CB_1$, $CB_2$, through $CB_N$). However, when the lock/unlock button 160 is in the locked position, the conducting element 162 breaks the circuit at the lock/unlock button 160. Thus, in the locked position, voltage is not supplied to the controller buttons 140, but voltage is still supplied to the indicators, such as voltage supply light 142 (through line 206) and visual display 126 (through line 204). In other words, in the locked position, none of the controller buttons 140 ($CB_1$, $CB_2$, through $CB_N$) are operational, but the indicators 126, 142, 150 can remain operational.

Figure 4:
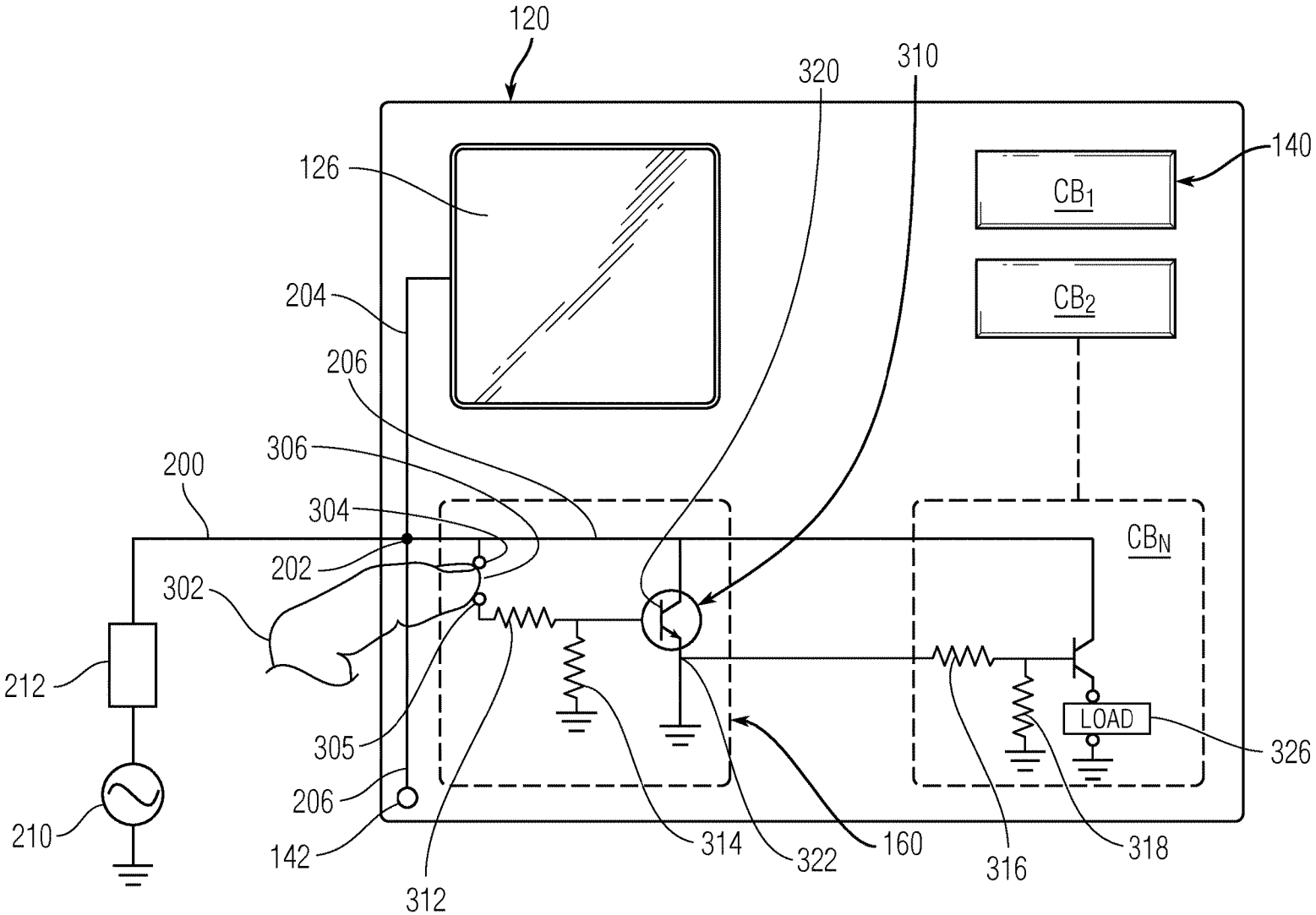
FIG. 4 is a schematic of an exemplary front face of a controller including a transistor for controlling the lock/unlock modes.

According to the embodiment of FIG. 4, the electromechanical toggle switch 160 of FIG. 3 is replaced with a transistor 310. The transistor 310 can be used as the lock/unlock button 160 to connect/disconnect the voltage source 210 to the controller buttons 140 ($CB_1$, $CB_2$, through $CB_N$) without affecting the voltage supply to the status indicators 126, 142, 150.

In the embodiment of FIG. 4, the circuitry of each of the controller buttons 140 can include a single and separate transistor. For simplicity, FIG. 4 illustrates circuitry only for controller button $CB_N$ in order to show transistor operation for achieving a switching function that connects/disconnects voltage from controller button $CB_N$. However, each of the controller buttons 140 ($CB_1$, $CB_2$, through $CB_N$) of the controller 120 of FIG. 4 can include such a transistor arrangement.

As shown in FIG. 4, when an actuator (such as an operator's finger 302) contacts and thereby actuates button 160 at position 306, the resistive characteristics of the finger 302 transfers the current at position 304 to position 305. In other words, the tip of the finger 302 makes a circuit between positions 304 and 305. Resistors 312 and 314 transfer the voltage at position 305 to the base 320 of transistor 310. The voltage at the base 320 turns on transistor 310, causing current to flow through the drain 322 of the transistor 310. The current at the drain 322 is input to controller button $CB_N$, flows through resistors 316 and 318, and turns on the controller button $CB_N$ transistor resulting in activation of load 326 (the load being the desired function to be performed by controller button $CB_N$ (such as adjusting the horizontal position of the table 100).

The circuit between positions 304 and 305 is broken when finger 302 is removed from position 306. Breaking this circuit turns off transistor 310, which turns off controller button $CB_N$ transistor, thereby placing controller button $CB_N$ in the locked position. As discussed above, the other controller buttons $CB_1$, $CB_2$, etc. can operate similarly to controller button $CB_N$.

Other exemplary embodiments can utilize or otherwise include processor-based technologies to implement the above operations. A few such embodiments are discussed below for exemplary purposes only, and are not contemplated as being limited to the disclosed embodiments.

In one embodiment, a flat-panel membrane keypad or keyboard can utilize processor-based technology to effect the lock/unlock modes and to implement the other controller button operations as discussed above. For example, the function of each controller button can be pre-defined within the processor. The processor can detect actuation of either of the lock/unlock modes and can send commands accordingly. For example, in the locked mode, the processor can send commands to prevent execution of table operations (such as table movement), i.e., operations actuated by controller buttons 140 ($CB_1$, $CB_2$, through $CB_N$) as discussed in the embodiments of FIGS. 3 and 4. Alternatively, in the unlocked mode, the processor enables commands to be sent to allow execution of table operations (such as table movement), i.e., operations actuated by controller buttons 140 ($CB_1$, $CB_2$, through $CB_N$) as discussed in the embodiments of FIGS. 3 and 4.

Figure 5:
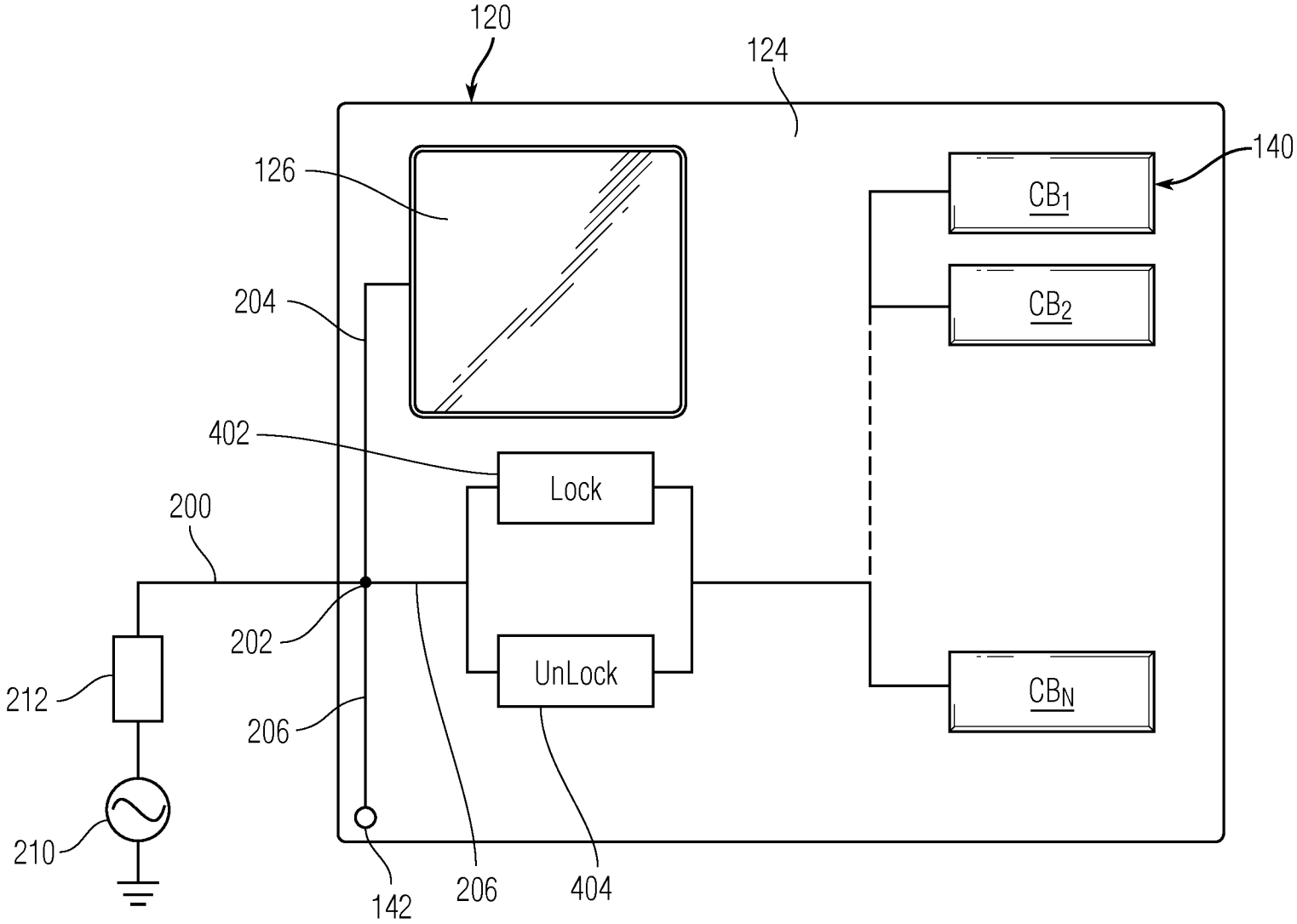
FIG. 5 is a schematic of an exemplary front face of a controller including processor-based technology for controlling the lock/unlock modes.

FIG. 5 shows an embodiment where the toggle switch of FIG. 3 and the transistors of FIG. 4 are replaced with processor-based technology to implement the lock/unlock operations. For example, the controller buttons 140 ($CB_1$, $CB_2$, through $CB_N$) can be implemented using flat-panel membrane keyboard technology, such as used to control household appliances, such as, for example, microwave ovens, photocopiers, and the like. Two separate buttons 402, 404 can also be provided to switch between the locked and unlocked modes, wherein one button 402 initiates the locked mode and the other button 404 initiates the unlocked mode.

Figure 6:
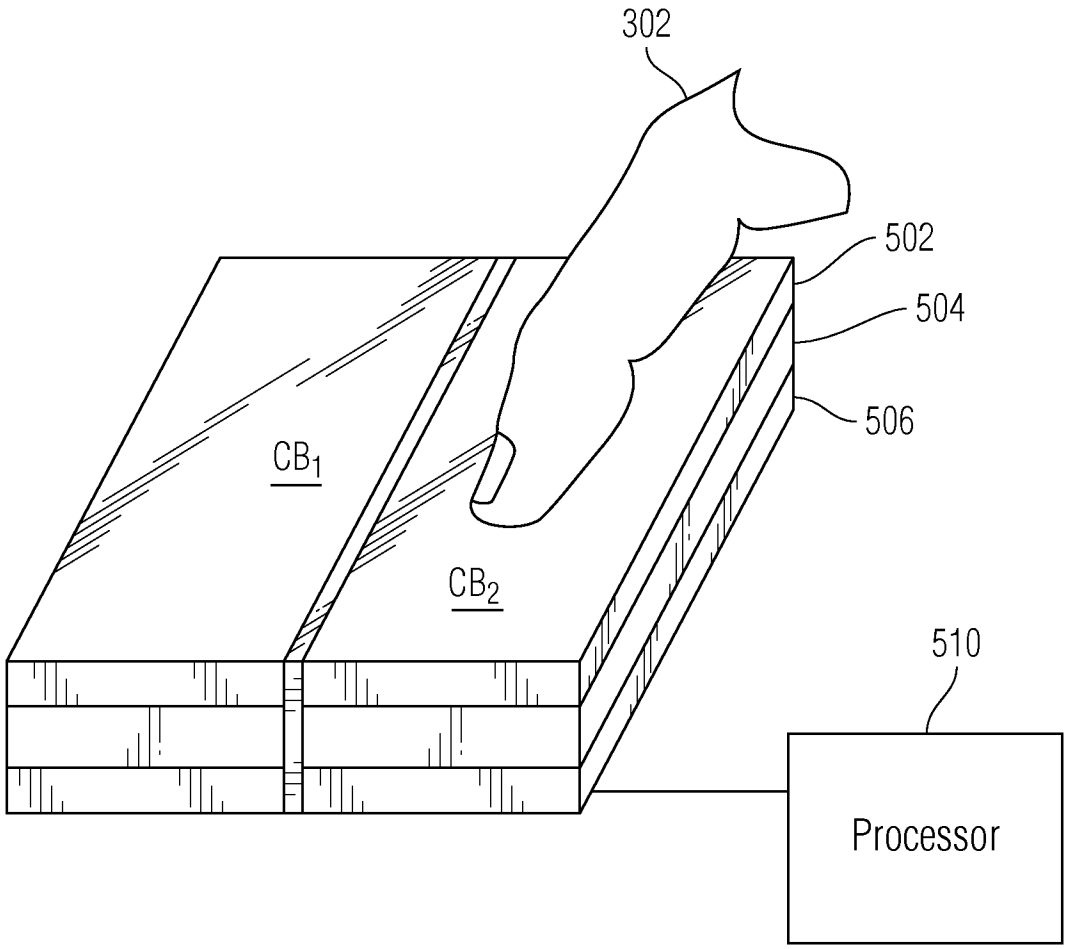
FIG. 6 shows an exemplary embodiment of a button that is defined by a two-button flat-panel membrane keyboard for use with a controller.

FIG. 6 shows an embodiment of a button that is defined by a two-button flat-panel membrane keyboard. Each button of the flat-panel membrane keyboard can include three layers, 502, 504, and 506. Layer 502 can include labels or other indicators that can specify the function of each button to a user, such as, for example, "Lock" or "Unlock." Layers 502 and 506 can be conductive, while layer 504 can be an insulating spacer layer. The insulating spacer layer 504 can insulate or otherwise separate layers 502 and 506 so that they are not normally electrically conductive and therefore, do not normally make an electrical circuit. Layers 502 and 506 can each include electrical stripes that extend perpendicular relative to each other. Thus, if an operator's finger 302 contacts one of the buttons, then the electrical stripes of layers 502 and 506 of that button form a grid. A voltage can be transmitted to a processor 510 that communicates with the keypad 124 once the two conducting layers 502 and 506 are in contact. The processor is thereby informed of the physical position on the grid where a voltage is detected. The processor then implements a pre-programmed function corresponding to the physical position on the grid. Accordingly, the processor can send commands consistent with the particular button that is selected, such as operating in the locked mode if the lock button is actuated.

The processor can be pre-programmed to perform other related or unrelated operations. For example, if the lock button is actuated so as to call-up the lock button instructions, then the processor can be programmed to stop executing or otherwise interrupt functions corresponding to other buttons (except the unlock button) even if actuated. For example, actuating the lock button can interrupt any table movement that may be in progress. Similarly, the processor can be programmed to resume operation (i.e., reactivate previous instructions) of other buttons that are actuated once the unlock button is actuated. For example, if a button is actuated to instruct table movement, but this movement has been interrupted by the table being placed in the lock mode, then the processor can be programmed to move the table upon entry into the unlock mode.

The voltage supplying the voltage light 142 and the visual display 126, as discussed with respect to FIGS. 3 and 4, are unaffected at all times regardless of whether the keypad is locked or unlocked. Therefore, even in a locked mode, while none of the controller buttons 140 ($CB_1$, $CB_2$, through $CB_N$) are operational, the indicators and all the status lights are unaffected and still active.

As an alternative to the embodiments that utilize buttons, other currently known or later developed technologies can be used to select and/or switch between the lock and unlock modes. For example, exemplary embodiments are intended to cover touch screens or other currently known or later developed types of keypads for performing the operations discussed above.

The operation of a buttonless embodiment is similar to that of the processor-based embodiment, disclosed above. The two are similar in that the physical location where a button is pressed or where a touchscreen panel is touched, are detected and accordingly, a processor implements a pre-programmed function corresponding to that physical location.

A resistive touchscreen panel can be used in accordance with a buttonless embodiment. The panel can be composed of several layers, the most important of which are two thin, electrically conductive layers separated by a narrow gap. When an object, such as a finger, presses down on a point on the panel's outer surface, the two metallic layers become connected at that point, and the panel then behaves as a pair of voltage dividers with connected outputs. This causes a change in the electrical current, which is registered as a touch event and the location of the change in the electrical current is sent to the controller for processing. The processor having a set of pre-programmed functions for each physical location, then executes the corresponding function. According to various embodiments, the function could be putting a stop to the execution of the functions corresponding to all the touch buttons on the panel used for adjusting the positioning of the table when a change in current is sensed at the location corresponding to the lock mode. Similarly, the function could be activating the execution of the functions corresponding to all the touch buttons on the panel used for adjusting the positioning of the table when a change in current is sensed at the location corresponding to the unlock mode.

When implementing a resistive touch screen panel, the processor can be pre-programmed such that when the panel is touched and a change in the electrical current at the physical location corresponding to the lock button is detected, the associated instruction is called to stop executing functions corresponding to the location of all the other buttons (except the unlock button) on the controller regardless of whether they are touched or not. Similarly, the processor can be pre-programmed such that when the panel is touched and a change in the electrical current at the physical location corresponding to the unlock button is detected, the associated instruction is called to reactivate the instructions corresponding to the location of all other buttons on the controller such that when they are pressed appropriate functions are performed.

The embodiments of FIGS. 4 and 5 can include an additional safety feature to prevent table operations, such as table movement, when in the locked mode. For example, the processor-based embodiments can supply voltage to the indicators/displays separately from the controller buttons to provide such protection.

An alternative processor-based embodiment replaces the resistive-based touch screen with a capacitive touch screen panel. An exemplary capacitive touch screen panel can include an insulator (such as glass) coated with a conductor. This technology is based on the fact that the human body is also an electrical conductor, and thus touching the surface of the screen (at a specific contact location) results in a distortion of the screen's electrostatic field and a measurable change in capacitance.

Various technologies can be incorporated to determine the contact location of the screen and then communicate the contact location to the processor. The processor can be programmed to have a set of pre-programmed functions corresponding to each contact location, such that the processor executes commands for a certain function upon determining that the corresponding screen location has been contacted. For example, the processor could execute commands consistent with ceasing all table movement upon determining that a location of the screen corresponding to the locked button has been touched.

As discussed above, this embodiment can be provided with an additional safety feature to prevent table operations, such as table movement, when in the locked mode. For example, the capacitive touch screen panel embodiment can supply voltage to the indicators/displays separately from the controller buttons to provide such protection.

The various embodiments discussed above relate to a hard-wired apparatus, which could be considered advantageous based on the requirements of an operating room. However, the various embodiments disclosed above can alternatively be implemented using wireless technologies. For example, appropriate transmitters and receivers can be incorporated into any of the embodiments illustrated in FIGS. 1-5 disclosed above. In one such embodiment, the controller 120 can be provided with a transmitter and the procedure table 100 can be provided with a receiver. Alternatively, both the controller 120 and the procedure table 100 can be equipped with a transceiver, enabling both the controller 120 and the procedure table 100 to communicate back and forth with one another.

Figure 7:
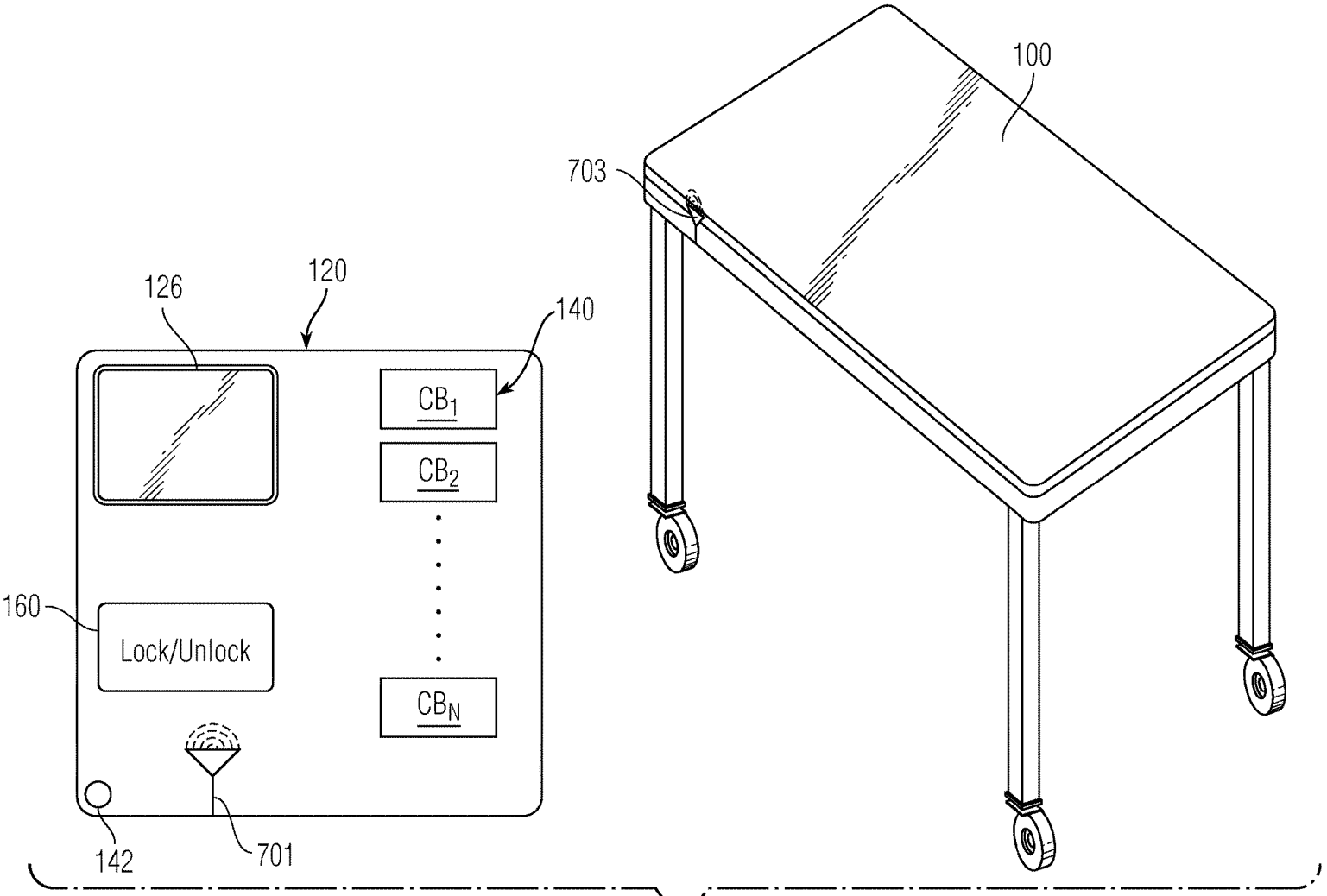
FIG. 7 shows an exemplary embodiment incorporating wireless communication(s) between the controller and the procedure table.

FIG. 7 illustrates an embodiment where the controller 120 includes a transmitter and/or transceiver 701, and the procedure table 100 includes a receiver and/or transceiver 703.

In addition or as an alternative, the controller 120 can include a delay feature. The delay feature can allow the controller 120 to remain in the locked mode for a period of time following actuation of the unlock button or any unlocking command.

The various embodiments of the delay feature are intended to cover any and all currently known and/or future developed technologies applicable for implementing the disclosed delay. Several technologies are discussed below for exemplary purposes and are not intended to be a complete list of all possible embodiments.

Figure 8:
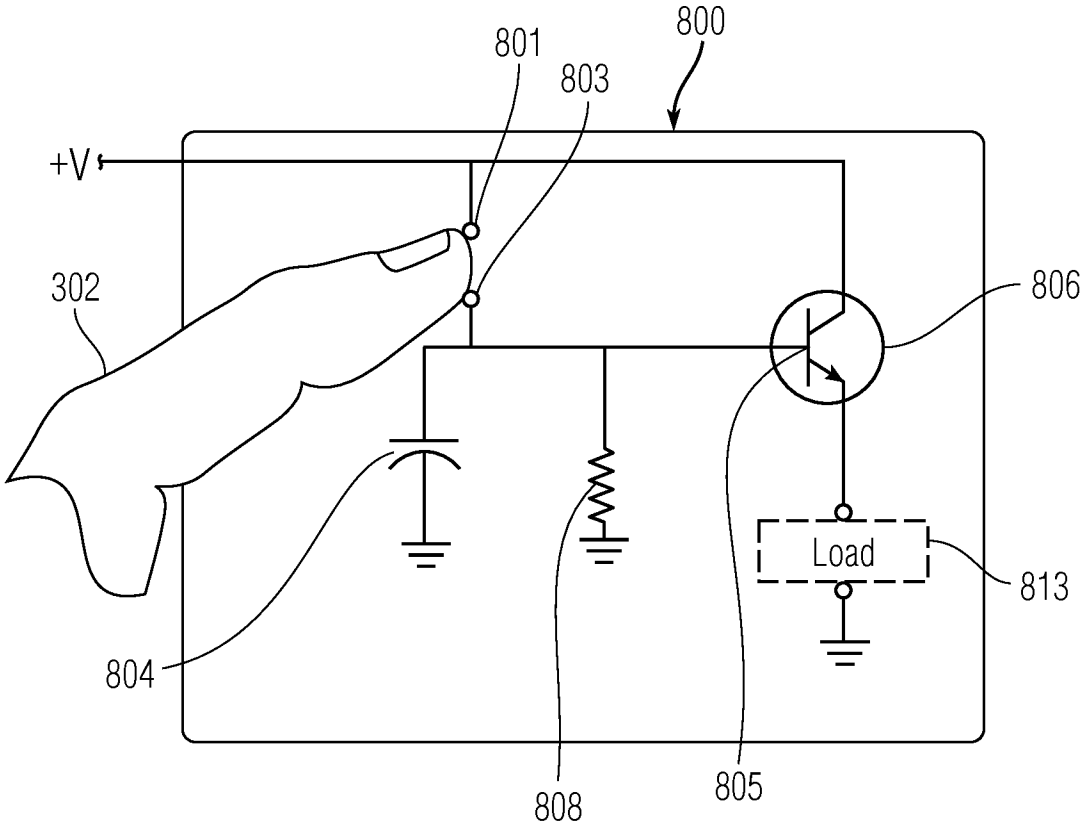
FIG. 8 shows an exemplary embodiment of a time-delay circuit for use with an exemplary controller.

Various embodiments of the delay feature can utilize or otherwise include electrical or electronic technologies to implement the above delay, such as, for example, a time-delay circuit. FIG. 8 discloses an exemplary time-delay circuit in which the lock/unlock button 160 of the embodiment of FIG. 4 is replaced with button 800.

As shown in FIG. 8, a capacitor 804 can charge-up when an electrical connection is made between contacts 801 and 803 via an operator's finger 302. However, voltage does not appear at location 805 (to thereby turn on transistor 806) until capacitor 804 charges completely. Similarly, when the electrical connection is broken between contacts 801 and 803 (i.e., the operator's finger 302 is removed), the voltage at location 805 does not disappear (to thereby turning off transistor 806) until capacitor 804 discharges. The capacitor 804 thereby introduces a delay between the time when the connection is made between contacts 801, 803 and the time when transistor 806 is turned on. Similarly, the capacitor 804 introduces a delay between the time when the connection is broken between contacts 801, 803 and the time when transistor 806 is turned off. The capacitance of the capacitor 804 can be chosen and calculated to provide the desired time delay.

Other embodiments can utilize or otherwise include processor-based technologies to implement the above delay. Exemplary embodiments that include processor-based technologies to implement the intended delay function similarly to previously disclosed processor based embodiments, except for the inclusion of a delay. For example, the previously disclosed processors can be modified to include instructions for executing a specified delay before implementing the locked/unlocked modes.

Other exemplary embodiments utilize or otherwise include touchscreen-based technologies to implement the above delay. Exemplary embodiments that include touchscreen-based technologies to implement the intended delay function similarly to previously disclosed touchscreen-based embodiments, except for the inclusion of a delay.

Other exemplary embodiments additionally provide an alarm or other indication that the delay has begun. In other words, upon enabling the keypad, an alarm or other indicator alerts the operator, such as a surgeon, to the fact that the unlocked mode has been actuated and thus the table (and patient) may be moved. This allows the operator, such as a surgeon, to perform at least one of the following: 1) tell the individual with the controller to NOT change the table position, 2) quickly remove his/her hands or any surgical instruments that may be at risk of damaging the patient if the table moves, or 3) do nothing if the critical part of the procedure is over and the surgeon would like a change in position of the table, or has no objection to a change in the position of the table.

Exemplary embodiments are intended to cover any and all currently known and later developed technologies for providing the above indication. For example, an alarm, e.g., a beeping sound, can be emitted at intervals, such as, for example, every second for three seconds, to alert the surgeon and/or other clinicians that someone has unlocked the keypad presumably with the intention of changing the table's position. After the three second delay, all of the keys/buttons that control the table can become functional. Other embodiments include longer or shorter periods of delay, although it may be beneficial for the delay to be longer than two seconds to provide sufficient time for recognition that the keypad is being enabled and for appropriate or defensive actions to be taken. Other embodiments can include a continuous beep or other alarm. Exemplary embodiments are even intended to cover other types of indicators that do not use sounds.

Various embodiments are intended to cover any and all currently known and/or future developed technologies applicable for indicating the above delay. A few such implementing technologies are discussed below for exemplary purposes only, but are not intended as a complete list of possible embodiments.

Some exemplary embodiments utilize or otherwise include electrical or electronic technologies to provide the above delay.

Other exemplary embodiments utilize or otherwise include processor-based technologies to provide the above delay.

Some embodiments are applicable to healthcare situations where three general types of movements of patients can occur when the patients are being supported on a procedure table, and all three of these movements should be avoided during critical parts of a procedure. These three general types of movements are discussed below.

The first movement type is movement of the base of the procedure table relative to the floor. This disadvantageous movement can be avoided by enabling a 'wheels lock' button on the controller 120 of the procedure table. This function locks the wheels such that the procedure table cannot roll during the procedure. This is important as surgeons often lean or partially support their body weight on the table. It is critical to know that the wheels are locked at all times, especially during critical parts of any procedure, such as operating on parts of the brain, eye, heart, or other delicate structure.

The second movement type is movement of the patient relative to the procedure table. This disadvantageous movement can include, for example, movement of the head while neurosurgeons are operating on the brain or movement of the head while ophthalmological surgeons are operating on the eye. This type of movement is largely eliminated by routine use of devices or tape to fix the patient's body (e.g., head in the case of brain and eye surgery) to the table. For example, in many neurosurgical procedures, a Mayfield-type device can be screwed into the patient's skull and then attached to the operating room table to prevent the patient's head from moving relative to the table.

The third movement type is movement of the patient resulting from movement of the procedure table elicited by the controller for the procedure table. Preventive measures described in the above first and second movement types are completely ineffective at preventing movement of the patient if movement by the procedure table is elicited by engaging any of the buttons, switches, and keys that control the movement of the table. For example, if the surgeon is operating on the brain using a microscope and the "up" control button is pushed for raising the table height, then this motion could cause a surgical instrument to plunge into the brain and lead to catastrophic damage of a vital structure or cause a cerebral aneurysm. In this situation, the surgeon has no way of knowing that somebody has depressed the control button on the controller, as the table is raised as soon as the control button is pushed without providing any warnings to the surgeon. Of course, harm to patients can also be caused by any of the other possible movements of the table, including lowering the table, tilting the table to the left, tilting the table to the right, Trendelenburg (head lower than feet) or reverse Trendelenburg (head higher than feet), and so on. It is also possible for the wheels to be "unlocked" after pushing the "wheel unlock" button which could lead to the unwanted rolling of the table and patient.

Any command elicited using the controller that results in harm to the patient can occur intentionally or inadvertently. An intentional command can result from an anesthesiologist or nurse that mistakenly thinks that the surgeon has requested a change in position of the table. An inadvertent command can result from the remote control being wedged against some other medical equipment or structure in the procedure room that results in a keypad button being pushed directing the table to change its position.

Some embodiments include a controller that addresses patient movement that can result in the patient engaging any of the keys or buttons that control the movement of the table, as set forth in the above third movement type. The keypad 124 of the controller 120 can be disabled while maintaining functionality of one or more status lights or indicators (e.g., a wheels locked condition), and can have an alarm and delay feature so upon enabling the keypad, an alarm sounds for several seconds alerting the surgeon to the fact that the remote will soon be operational again and the table may move.

Exemplary embodiments are intended to cover a host of operations other than, or in addition to, those disclosed above. For example, some exemplary embodiments include an actuator indicator that indicates actuation of at least one of the unlock actuator and the lock actuator (such as is indicated by reference number 160 in FIGS. 2-4 and 7 or reference number 402, 404 in FIG. 5). Exemplary embodiments are intended to cover actuator indicators that: 1) only indicate actuation of the unlock actuator, 2) only indicate actuation of the lock actuator, and/or 3) indicate actuation of both the unlock and lock actuators. In some embodiments that indicate actuation of both the unlock and lock actuators, the actuator indicator provides a first indication upon actuation of the unlock actuator and a second indication that is different from the first indication upon actuation of the lock actuator.

Exemplary embodiments are intended to cover any currently known or later developed structure(s) or method(s) for providing the above actuator indication(s). For example, the actuator indication may be audible, visual, vibration, etc. As an example, in some embodiments that indicate actuation of both the unlock and lock actuators, the first indication (provided upon actuation of the unlock actuator) can be a certain and/or predetermined noise and the second indication (provided upon actuation of the lock actuator) can be a different type of noise. For example, the first indication can be two short beeps, while the second indication can be three long beeps, or vice versa. In some embodiments, the difference in indication can be tailored to provide medical care provider(s) with more time to take appropriate action during the unlocking phase. However, these embodiments are only provided for exemplary purposes, and as indicated above, embodiments are intended to cover any currently known or later developed structure(s) or method(s) for providing the above actuator indication(s).

Still other exemplary embodiments include an operator actuator 125 (shown in FIG. 1), that is separate from the unlock and lock actuators, and that separately provides the operation of at least one of the unlock and lock actuators. In other words, the operator actuator 125 provides a duplicative mechanism for at least one of the unlock and lock actuators. Thus, in some embodiments, the operator actuator 125 is in effect a duplicate of only the unlock actuator, while in other embodiments the operator actuator 125 is in effect a duplicate of only the lock actuator. In still other embodiments, the operator actuator 125 is a duplicate of both the unlock and lock actuators. In some of all of these embodiments, the procedure table is structured to support a patient undergoing a medical procedure conducted by a surgeon, and the operator actuator 125 is structured and disposed to be actuated by the surgeon.

Exemplary embodiments are intended to cover any currently known or later developed structure(s) or method(s) for providing the above operator actuator. For example, the operator actuator can be structured and disposed to be operated by a variety of medical care providers, including but not limited to cardiologist(s), interventional radiologist(s), surgeon(s), or any other relevant proceduralist(s). In the context of surgery, one specific embodiment is a type of pedal that can be operated by a surgeon's foot.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A controller for use with a procedure table that includes a driver that moves the table and at least one indicator that indicates a status of a condition of the table, the controller comprising:

a user interface comprising a plurality of first buttons and at least one second button, each of the first buttons being configured to be actuated by a user to cause a corresponding movement of the table, the at least one second button being configured to be actuated by a user to cause the controller to switch between a first mode of operation of the controller and a second mode of operation of the controller;

an unlock actuator that enables the driver to move the table in the first mode of operation of the controller; and a lock actuator that prevents the driver from moving the table while enabling the at least one indicator to continue indicating the status in the second mode of operation of the controller, wherein, in the first mode of operation of the controller, each of the plurality of first buttons causes a corresponding movement of the table upon user actuation of the corresponding first button, wherein, in the second mode of operation of the controller, user actuation of any of the plurality of first buttons fails to cause any movement of the table, wherein the first buttons comprise all user inputs to the controller that cause the controller to move the table, wherein the at least one second button of the user interface is configured to be actuated by a user to cause the controller to switch between the first mode of operation of the controller and the second mode of operation of the controller with a single gesture input by a user, wherein the at least one second button comprises at least one mode button configured to cause the controller to operate in the first mode of operation in response to receiving an input by the user, and wherein switching to the second mode of operation of the controller causes all first buttons of the controller to be disabled and does not cause the at least one mode button to become disabled.

2. The controller of claim 1, wherein the unlock actuator is configured to enable the driver to move the table only after expiration of a specified delay period that begins upon actuation of the unlock actuator.

3. The controller of claim 2, further including a delay period indicator that configured to indicate initiation of the delay period upon actuation of the unlock actuator, and configured to terminate the indication upon expiration of the delay period.

4. The controller of claim 1, wherein the at least one second button comprises an unlock button as the at least one mode button and a separate lock button, and wherein the unlock actuator is responsive to the unlock button to cause the controller to operate in the first mode of operation, and the lock actuator is responsive to a single depression of the lock button to cause the controller to operate in the second mode of operation.

5. The controller of claim 1, wherein the unlock and lock actuators comprises only a single switch defining unlock and lock positions, the unlock position actuating the unlock actuator to cause the controller to operate in the first mode of operation and the lock position actuating the lock actuator to cause the controller to operate in the second mode of operation.

6. The controller of claim 5, wherein the single switch is an electromechanical switch.

7. The controller of claim 6, wherein the single switch is a transistor.

8. The controller of claim 1, wherein the at least one second button comprises a touch screen display.

9. The controller of claim 1, wherein the controller is disposed remote from the procedure table.

10. The controller of claim 1, wherein the controller is disposed proximal the procedure table.

11. The controller of claim 1, further including an indicator power circuit that provides power to the at least one indicator, and an unlock/lock actuator power circuit that provides power to the unlock and lock actuators, at least a part of the indicator power circuit being separate from the unlock/lock power circuit.

12. The controller of claim 1, further comprising an actuator indicator that indicates actuation of at least one of the unlock actuator and the lock actuator.

13. The controller of claim 12, wherein the actuator indicator indicates actuation of both of the unlock and lock actuators, by providing a first indication upon actuation of the unlock actuator and a second indication that is different from the first indication upon actuation of the lock actuator.

14. The controller of claim 1, further including an operator actuator, that is separate from the unlock and lock actuators, and that separately provides the operation of at least one of the unlock and lock actuators.

15. The controller of claim 14, wherein the procedure table is structured to support a patient undergoing a medical procedure conducted by a surgeon, and the operator actuator is structured and disposed to be actuated by the surgeon.

16. The controller of claim 1, wherein the at least one second button consists of a single mode button and is configured to cause the controller to switch from operating in the first mode of operation to the second mode of operation upon receiving a user input.

17. The controller of claim 1, wherein the at least one indicator comprises a plurality of first indicators to indicate an operational status associated with at least some of the first buttons and one or more second indicators to indicate a status of a feature of the procedure table that is not affected by any user input to any of the first buttons, wherein switching from the first mode of operation of the controller to the second mode of operation of the controller has no impact on status indications of the plurality of first indicators and the one or more second indicators.

18. The controller of claim 17, wherein the one or more second indicators includes a power source indicator indicating a supply of a power source.

19. The controller of claim 17, wherein the at least one indicator comprises a wheels lock indicator indicating whether wheels of the procedure table are locked or unlocked.

20. The controller of claim 1, wherein switching from the first mode of operation of the controller to the second mode of operation of the controller has no impact on all status indications of the at least one indicator.

21. The controller of claim 1, wherein the at least one mode button is a single mode button and is configured to cause the controller to operate in the first mode of operation in response to receiving the single gesture input by the user, wherein switching to the second mode of operation of the controller causes all buttons of the controller to be disabled with the exception of the mode button.

22. A procedure table, comprising:

a driver that moves the table;

at least one indicator that indicates status of a condition of the table;

a user interface comprising a plurality of first buttons and at least one second button, each of the first buttons being configured to be actuated by a user to cause a corresponding movement of the table, the at least one second button being configured to be actuated by a user to cause the table to switch between a first mode of operation of the table and a second mode of operation of the table;

an unlock actuator that enables the driver to move the table in the first mode of operation of the table; and a lock actuator that prevents the driver from moving the table while enabling the at least one indicator to continue indicating the status in the second mode of operation of the table wherein, in the first mode of operation of the table, each of the plurality of first buttons causes a corresponding movement of the table upon user actuation of the corresponding first button, wherein, in the second mode of operation of the table, user actuation of any of the plurality of first buttons fails to cause any movement of the table, wherein the first buttons comprise all user inputs of the user interface to the table that cause the table to move, wherein the at least one second button of the user interface is configured to be actuated by a user to cause switching from the first mode of operation to the second mode of operation with a single gesture input by a user, wherein the at least one second button comprises at least one mode button configured to cause entering the first mode of operation in response to receiving an input by the user, and wherein switching to the second mode of operation causes all first buttons of the controller to be disabled and does not cause the at least one mode button to become disabled.

23. The procedure table of claim 22, wherein the unlock actuator is configured to enable the driver to move the table only after expiration of a specified delay period that begins upon actuation of the unlock actuator.

24. The procedure table of claim 23, further including a delay period indicator that indicates initiation of the delay period upon actuation of the unlock actuator, and that terminates the indication upon expiration of the delay period.

25. A controller for use with a procedure table that includes a driver that moves the table and at least one indicator that indicates a status of a condition of the table, the controller comprising:

a user interface comprising a plurality of first buttons and at least one second button, each of the first buttons being configured to be actuated by a user to cause a corresponding movement of the table, the at least one second button being configured to be actuated by a user to cause the controller to switch between a first mode of operation of the controller and a second mode of operation of the controller;

unlock means for enabling the driver to move the table in the first mode of operation of the controller; and lock means for preventing the driver from moving the table while enabling the at least one indicator to continue indicating the status in the second mode of operation of the controller, wherein, in the first mode of operation of the controller, each of the plurality of first buttons causes a corresponding movement of the table upon user actuation of the corresponding first button, wherein, in the second mode of operation of the controller, user actuation of any of the plurality of first buttons fails to cause any movement of the table, wherein the first buttons comprise all user inputs to the controller that cause the controller to move the table, wherein the at least one second button of the user interface is configured to be actuated by a user to cause the controller to switch between the first mode of operation of the controller and the second mode of operation of the controller with a single gesture input by a user, wherein the at least one second button comprises at least one mode button configured to cause the controller to operate in the first mode of operation in response to receiving an input by the user, and wherein switching to the second mode of operation of the controller causes all first buttons of the controller to be disabled and does not cause the at least one mode button to become disabled.

26. The controller of claim 25, wherein the unlock means does not enable the driver to move the table until after expiration of a specified delay period that begins upon actuation of the unlock actuator.

27. The controller of claim 26, further including a delay period indicator means for indicating initiation of the delay period upon actuation of the unlock means, and that terminates the indication upon expiration of the delay period.

28. A non-transitory computer readable storage medium having stored therein a computer program for controlling a procedure table that includes a driver that moves the table and at least one indicator that indicates a status of a condition of the table, the computer program comprising:

a user input program for enabling a plurality of first user inputs to cause a corresponding movement of the table and for enabling second user inputs to cause the table to switch between a first mode of operation of the table to a second mode of operation of the table;

an unlock program for enabling the driver to move the table in the first mode of operation of the table; and a lock program for preventing the driver from moving the table while enabling the at least one indicator to continue indicating the status in the second mode of operation of the table, wherein, in the first mode of operation of the table, each of the plurality of first user inputs causes a corresponding movement of the table, wherein, in the second mode of operation of the table, each of the plurality of first user inputs fails to cause any movement of the table, wherein the first user inputs comprise all user inputs of the user to the table that cause the table to move, wherein the at least one second button of the user interface is configured to be actuated by a user to cause switching from the first mode of operation to the second mode of operation with a single gesture input by a user, wherein the at least one second button comprises at least one mode button configured to cause entering the first mode of operation in response to receiving an input by the user, and wherein switching to the second mode of operation causes all first buttons of the controller to be disabled and does not cause the at least one mode button to become disabled.

29. The non-transitory computer readable storage medium of claim 28, wherein the unlock program does not enable the driver to move the table until after expiration of a specified delay period that begins upon actuation of the unlock program.

30. The non-transitory computer readable storage medium of claim 29, wherein the computer program stored on the non-transitory computer readable storage medium includes a delay period indicator program for indicating initiation of the delay period upon actuation of the unlock program, and that terminates the indication upon expiration of the delay period.

* * * * *